US005810580A

United States Patent [19]

Vautard et al.

[11] Patent Number: 5,810,580

[45] Date of Patent: Sep. 22, 1998

[54] MIXING RABBLE FOR A ROTARY HEARTH FURNACE

[75] Inventors: Gary J. Vautard, North Huntingdon; Clint E. Chisholm, Monongahela, both of Pa.

[73] Assignee: Techint Technologies Inc., Coraopolis, Pa.

[21] Appl. No.: 754,860

[22] Filed: Nov. 22, 1996

[51] Int. Cl.[6] ..... F27B 9/16

[52] U.S. Cl. ..... 432/139; 432/138; 432/142

[58] Field of Search ..... 432/138, 139, 432/142, 162; 110/247

[56] References Cited

U.S. PATENT DOCUMENTS

| | | | |
|---|---|---|---|
| 979,937 | 12/1910 | Edwards . | |
| 1,732,843 | 10/1929 | Halse . | |
| 1,836,002 | 7/1931 | Balz | 432/139 |
| 3,475,286 | 10/1969 | Kemmerer, Jr. et al. | 202/117 |
| 3,541,603 | 11/1970 | Tsujihata et al. | 266/21 |
| 3,612,497 | 10/1971 | Allred | 263/22 |
| 3,652,404 | 3/1972 | Schilson | 201/33 |
| 3,740,184 | 6/1973 | Oleszko | 432/239 |
| 3,788,800 | 1/1974 | Middleton et al. | 432/235 |
| 3,859,172 | 1/1975 | Wilt, Jr. | 202/117 |
| 3,874,644 | 4/1975 | Grimes | 266/20 |
| 3,905,757 | 9/1975 | Von Dreusche, Jr. | 432/18 |
| 3,988,012 | 10/1976 | Jemal | 266/179 |
| 4,149,845 | 4/1979 | Merrill, Jr. | 432/138 |
| 4,215,981 | 8/1980 | Von Dreusche, Jr. | 432/139 |
| 4,669,977 | 6/1987 | Johnson et al. | 432/139 |
| 4,702,694 | 10/1987 | Johnson et al. | 432/133 |
| 4,818,222 | 4/1989 | Docherty et al. | 432/138 |
| 4,834,650 | 5/1989 | Docherty et al. | 432/138 |
| 4,842,051 | 6/1989 | Brownlee | 165/93 |
| 5,173,047 | 12/1992 | Shefsiek | 432/139 |

*Primary Examiner*—Teresa J. Walberg
*Assistant Examiner*—Jiping Lu
*Attorney, Agent, or Firm*—Webb Ziesenheim Bruening Logsdon Orkin & Hanson, P.C.

[57] ABSTRACT

A rotary hearth furnace has a mixing rabble arrangement that includes a first rabble disposed upstream a flow of material on the hearth and a second rabble disposed downstream a flow of material on the hearth. The first and second rabbles are disposed at an acute angle with respect to a center of rotation of the hearth in a manner so that a plane defined by a plow of the first rabble intersects a plane defined by a plow of the second rabble adjacent the leading edge or training edge of the plow of the second rabble. The rabbles cooperate to produce a counter-rolling action in the material as the material is advanced into contact with the rabbles by movement of the hearth relative to the rabbles.

6 Claims, 6 Drawing Sheets

MIXING RABBLE FOR A ROTARY HEARTH FURNACE

BACKGROUND OF THE INVENTION

1. Field of the Invention

The present invention relates to configuration of a rabble useful for mixing material during processing in a rotary hearth furnace.

2. Prior Art

Rotary hearth furnaces have long been used for heating materials. Such furnaces typically include a circular hearth or floor, cylindrical sidewalls, a stationary roof, a rabble system, means for imparting relative motion between the hearth and the rabble system, means for introducing material into the furnace for treatment and means for discharging treated material from the furnace. Rabble systems typically include a plurality of rabbles supported above and extending closely adjacent the floor of the hearth for engaging and advancing materials deposited thereon from an area of introduction to a discharge area in response to relative motion between the hearth and the rabbles.

A typical rabble system includes transport rabbles and a discharge rabble. The transport rabbles are utilized to advance the material on the hearth and to expose to the furnace atmosphere previously unexposed material. The discharge rabble is another form of transport rabble that is utilized to discharge treated material to a discharge chute. In operation, the individual rabbles are arranged with an active face oriented to contact and progressively move material on the hearth. The primary concern being that the active face of the rabble contact and move material across the floor in a desired direction in response to relative motion between the hearth and the rabbles.

Prior art rabble systems sometimes include mixing rabbles to effect additional mixing of the material during treatment. Mixing rabbles work in a complimentary manner to effect mixing of material in a given circumference of the furnace. In one prior art embodiment, a first, upstream, mixing rabble in a given circumference urges the material towards the point of discharge and a second, downstream, mixing rabble in the same circumference returns the material to a location on the circumference from where it was originally located. The use of mixing rabbles in the prior art facilitated shifting of material between the inside and the outside of the hearth. Prior art mixing rabbles are commonly installed at obtuse angles with respect to a given circumference of the hearth and the rotational center of the furnace. Placement of the prior art mixing rabbles in this manner, however, did not ensure material located close to the surface of the hearth was moved in a manner to facilitate exposure of all of the material to the furnace atmosphere.

It is an object of the present invention to provide a mixing rabble arrangement that engenders inversion of material on the hearth of a furnace. It is another object of the present invention to maintain material mixed by the mixing rabbles at a given circumference on the hearth. It is still a further object of the invention to provide a compact mixing rabble arrangement that facilitates sufficient mixing of material in less space than mixing rabble arrangements of the prior art.

SUMMARY OF THE INVENTION

Disadvantages of the prior art are reduced or overcome by the use of a rabble arrangement having a first rabble disposed upstream in a flow of material on a hearth of a rotary furnace having a center of rotation. The first rabble has a first plow having an active face and a leading edge. The active face of the first plow defines a first plane disposed transverse to the direction of flow of the material. The rabble arrangement also includes second rabble disposed downstream in the flow of material. The second rabble has a second plow having an active face, a leading edge and a trailing edge. The active face of the second plow defines a second plane disposed transverse to the first plane and the direction of flow of the material. The first and second rabbles are positioned so that the first plane intersects the second plane adjacent to the leading edge or the trailing edge of the second plow. The first rabble and the second rabble are disposed at an acute angle with respect to the center of rotation.

In accordance with one embodiment of the invention, the first rabble includes a third plow having an active face and a leading edge disposed adjacent the leading edge of the first plow. The active face of the third plow defines a third plane disposed transverse to the first plane and the direction of flow of the material. The first plow and third plow of the first rabble form a V wherein the active faces are positioned on the outside surfaces of the V and wherein the leading edge of the first plow and/or the third plow forms the point of the V. The V of the first rabble is positioned so that the point of the V is oriented in an upstream direction of the flow of material and the open end thereof is oriented in an downstream direction of the flow of material. The second rabble includes a fourth plow having an active face, a leading edge and a trailing edge disposed adjacent the trailing edge of the second plow. The active face of the fourth plow defines a fourth plane disposed transverse to the third plane and the direction of flow of the material. The fourth plow is positioned so that the third plane intersects the fourth plane adjacent the leading edge and/or the trailing edge of the fourth plow. The second plow and fourth plow of the second rabble form a V wherein the active faces are positioned on the inside surfaces of the V and wherein the trailing edge of the second plow and/or the fourth plow forms the point of the V. The V of the second rabble is positioned so that the point of the V is oriented in an downstream direction of the flow of material and the open end of the V is oriented in an upstream direction of the flow of material and in opposition to the open end of the V of the first rabble.

In accordance with another aspect of the invention, the leading edge of the first plow and the leading edge of the third plow form a common leading edge and the trailing edge of the second plow and the trailing edge of the fourth plow form a common trailing edge. The second rabble includes an aperture for allowing material disposed between the active face of the second plow and the active face of the fourth plow to flow therethrough.

In accordance with another aspect of the invention, a wedge is disposed outwardly along a lower portion of the active face of a plow. The wedge has a lower surface extending generally normal to the active face and an inclined surface extending between a distal edge of the wedge and a portion of the active face above the lower surface. The wedge gradually urges material upward from the hearth in response to movement of the hearth relative to the plow.

In accordance with another embodiment of the invention, a rotary furnace has a hearth and a rabble arrangement. The rabble arrangement is fixedly supported above the hearth for urging material disposed on the hearth between paths on the hearth in response to relative movement between the hearth and the rabble arrangement. The rabble arrangement includes a first rabble that has a first plow with an active face for contacting material in a first path on the hearth. The first rabble is positioned to urge material in the first path to a second path on the hearth. The movement of material from the first path to the second path creates a void behind the first plow. The rabble arrangement further includes a second rabble that has a second plow with an active face for contacting material in the second path. The second plow is positioned to urge material from the second path towards the first path and into the void created behind the first plow.

In accordance with another aspect of the invention, the first rabble further includes a third plow disposed adjacent the first plow. The third plow has an active face for urging material from the first path to a third path opposite the second path thereby creating a void behind the third plow in the first path. The second rabble further includes a fourth plow disposed adjacent the second plow. The fourth plow has an active face for urging material from the third path back towards the first path and into the void behind the third plow.

In accordance with another aspect of the invention, the plows of the first rabble form a V wherein the point of the V is oriented upstream the flow of material and the plows of the second rabble form a V wherein the point of the V is oriented downstream the flow of material. The first and second rabbles are disposed substantially symmetrical about a line between the point of the V of the first rabble and the point of the V of the second rabble.

Still other advantages will become apparent upon reading and understanding the following detailed description.

BRIEF DESCRIPTION OF THE DRAWINGS

The invention may take form in various parts and arrangements of parts, and in various steps and arrangements of steps. The drawings are only for the purpose of illustrating the prior art and/or preferred embodiments and are not be construed as limiting the invention.

DETAILED DESCRIPTION OF THE PREFERRED EMBODIMENT

Figure 1:
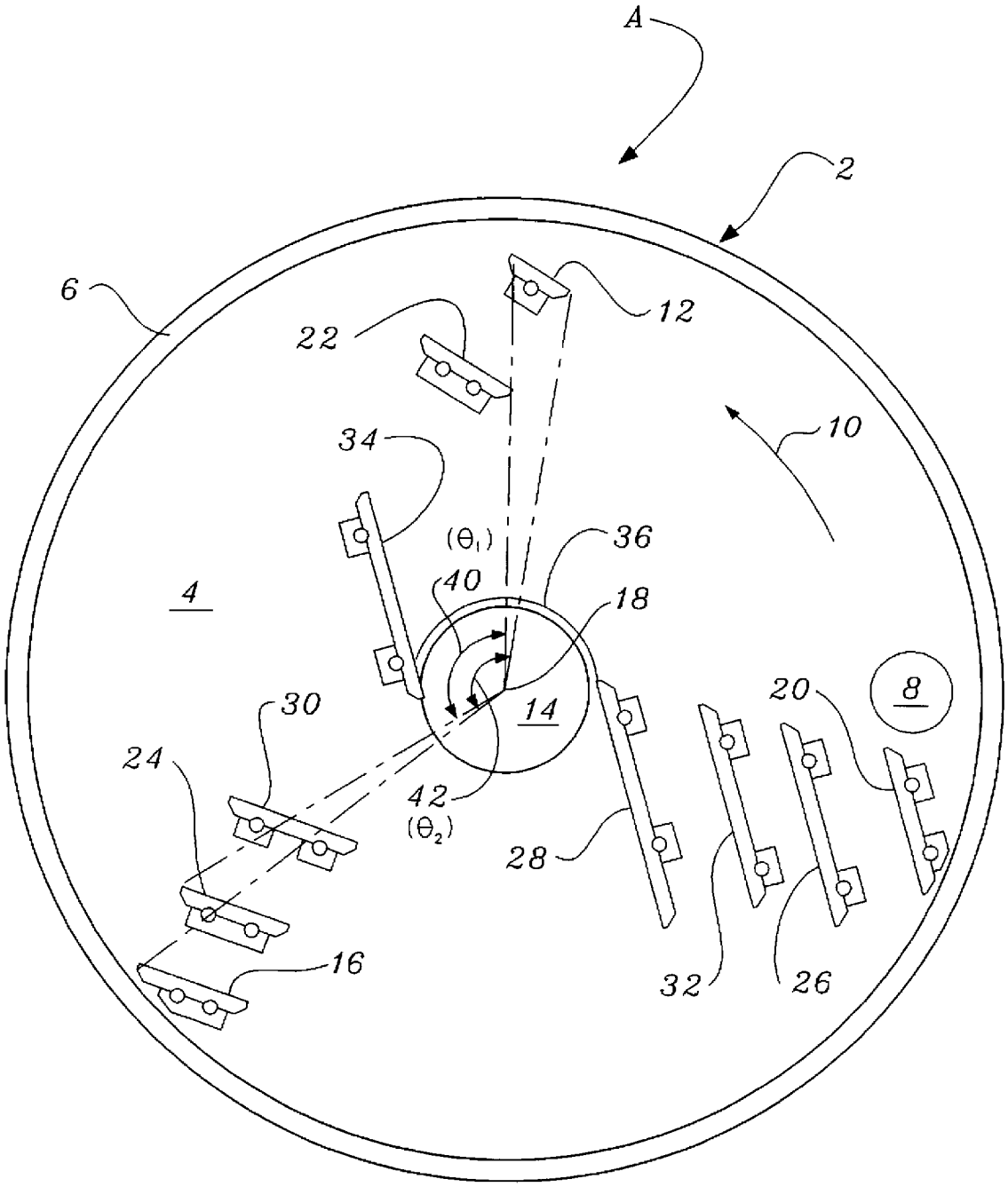
Fig.1. Prior Art
FIG. 1 is a plan view of a prior art rotary furnace showing a plurality of rabbles positioned therein above a floor of the furnace.

With reference to FIG. 1, a prior art rotary furnace includes a hearth 2 on which material to be treated is disposed as arrangement A. The materials to be treated are deposited on floor 4 of the hearth 2 adjacent its outer rim 6 via inlet 8 in a manner know in the art. A plurality of rabbles, e.g., 12, 16, 20, 22, 24, 26, 28, 30, 32 and 34, are fixedly supported above the floor 4 and extended closely adjacent the floor 4 of the hearth in a manner known in the art. A means is provided (not shown) for imparting relative motion between the floor 4 and the plurality of rabbles.

Rotation of the floor 4 in a counter-clock wise (CCW) direction 10 moves the material deposited on the floor 4 at inlet 8 into contact with a first, leading, mixing rabble 12. The first mixing rabble 12 urges the material radially away from a discharge chute 14 formed in a central part of the floor 4. Further CCW rotation of the hearth brings the material moved by the first mixing rabble 12 into contact with a second, trailing, mixing rabble 16 that urges the material radially towards the discharge chute 14. The material exiting the second mixing rabble 16 is approximately at the same radial distance from a center of rotation 18 of the hearth as material entering the first mixing rabble 12.

Material exiting the mixing second rabble 16 is CCW rotated on the hearth 2 into contact with a first transport rabble 20 which advances the material radially towards the discharge chute 14. Material radially advanced by the first transport rabble is CCW rotated into contact with a third mixing rabble 22 which urges the material radially away from the discharge chute 14. Material exiting the third mixing rabble 22 is CCW rotated into contact with fourth mixing rabble 24 which urges the material radially towards the discharge chute 14. Like material urged by the first and second mixing rabbles, material exiting the fourth mixing rabble 24 is approximately at the same radial distance from the center of rotation 18 as material entering the third mixing rabble 22. Material exiting the fourth mixing rabble 24 is CCW rotated into contact with a second transport rabble 26 which radially advances the material towards the discharge chute 14. A third transport rabble 28, a backfill rabble 30, and an intermediate rabble 32 in conjunction with the CCW rotation of the hearth progressively advance the material radially on the hearth towards the discharge chute 14. A discharge rabble 34, positioned adjacent an inner rim 36 of the hearth, advances the material into the discharge chute 14 wherein the material is directed to a suitable means (not shown) for conveying the material away from the hearth in a manner known in the art.

In operation, the mixing rabbles shift the material back and forth on a given circumference on the floor of the hearth to facilitate exposure of the material to the atmosphere in the furnace. In contrast, the transport rabbles, intermediate rabble, backfill rabble and discharge rabble progressively advance or plow the material towards the discharge chute 48, albeit with less mixing of the material than is occasioned by the mixing rabbles. As illustrated in FIG. 1, related mixing rabbles are positioned at an obtuse angle with respect to the center of rotation 18. Specifically, with respect to the center of rotation 18, the leading edge of the first and second mixing rabbles 12, 16 are positioned at first angle 40 ($\theta_1$) and the leading edge of the third and fourth mixing rabbles 22, 24 are positioned at a second angle 42 ($\theta_2$).

Figure 2A:
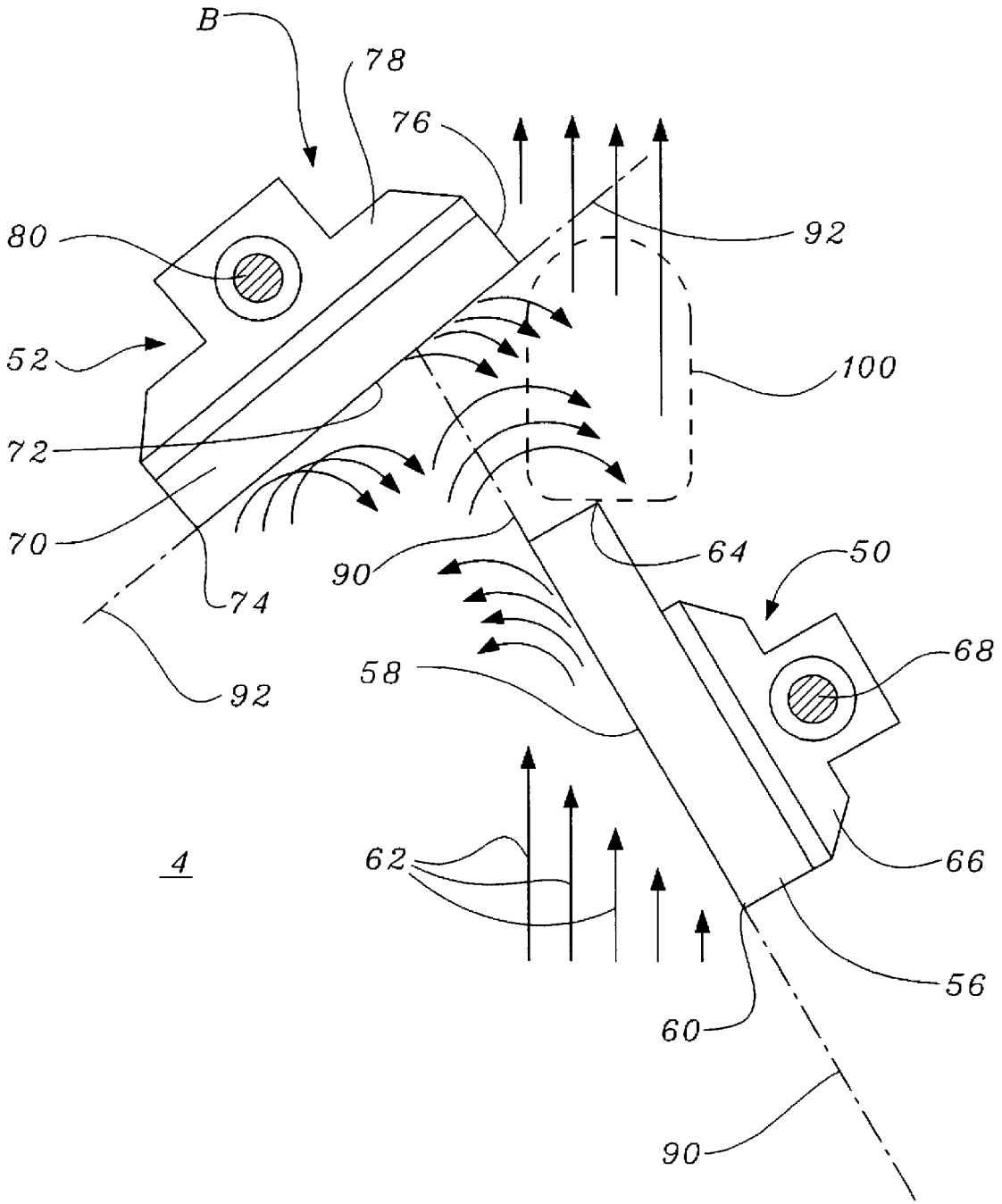
FIG. 2*a* is a plan view of a rabble arrangement in accordance with an embodiment of the present invention in relation to a flow of material on a floor of a furnace.
Figure 2B:
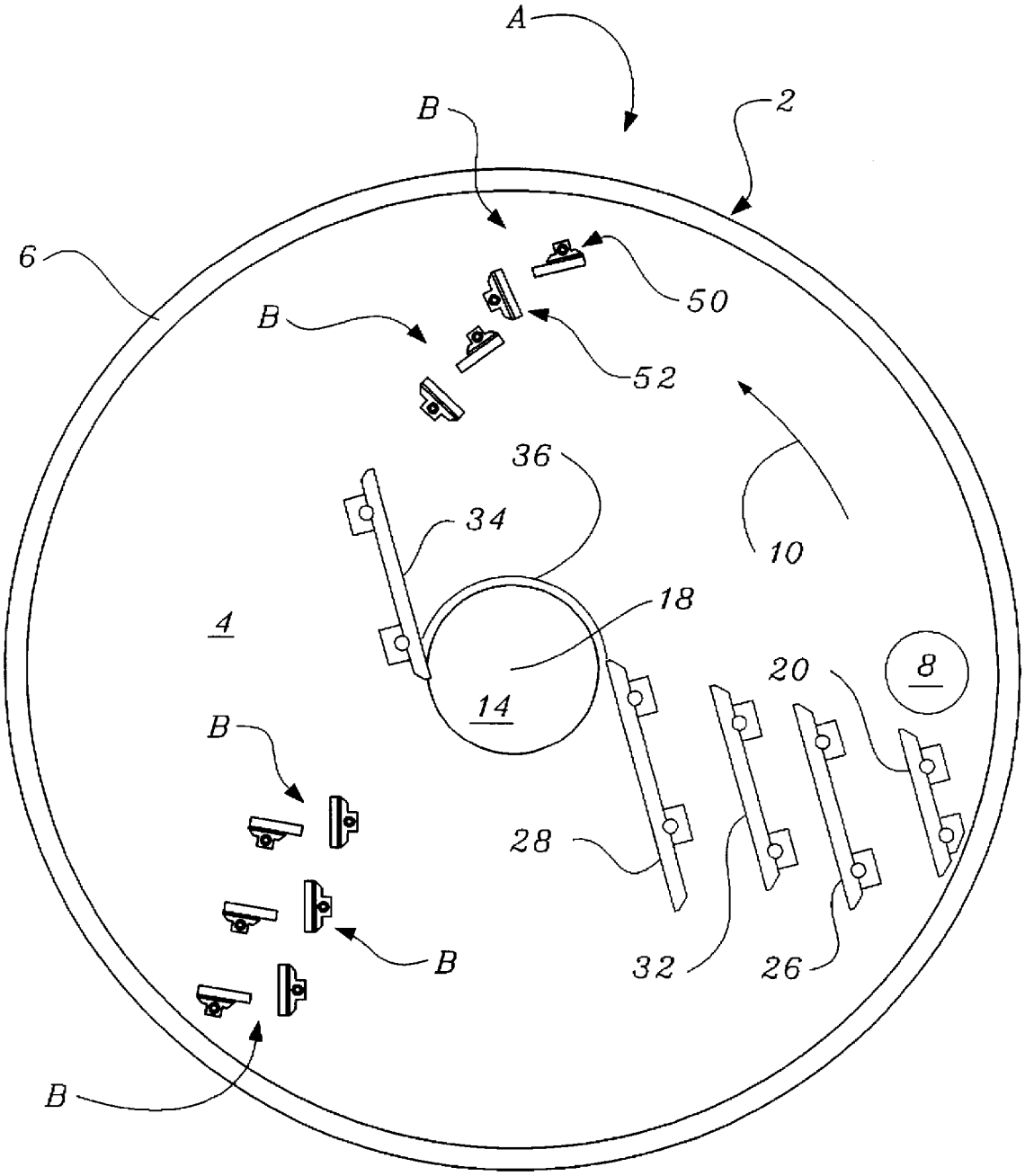
FIG. 2*b* is a plan view of the rotary hearth furnace of FIG. 1 having a plurality of the rabble arrangements of FIG. 2*a* positioned therein.

With reference to FIGS. 2*a*–2*b* and with continuing reference to FIG. 1, in accordance with the present invention, a rabble arrangement B includes a first flat blade rabble 50 and a second flat blade rabble 52. The first and second rabbles 50, 52 are fixedly supported above and extend closely adjacent the floor 4. Material deposited on the floor 4 is moved into contact with the rabble arrangement B by movement of the floor 4 relative to the rabble arrangement B. The rabble arrangement B causes mixing of the material on the floor in a manner to be described hereinafter in greater detail.

The first rabble 50 includes a first plow 56 having a first active face 58 for contacting the material. The first plow has a leading edge 60 and a trailing edge 64 which extend upwardly from the floor 4. The first plow 50 is positioned so that the leading edge 60 is upstream in a direction of material flow 62 advancing towards the rabble arrangement B and the second edge 64 is downstream the direction of material flow 62 retreating from the rabble arrangement B. The first plow 56 is attached to a first support 66 which in-turn is attached to shaft 68. The second rabble 52 includes a second plow 70 which has a second active face 72 for contacting the material, a leading edge 74 and a trailing edge 76. The leading edge 74 and a trailing edge 76 of the second plow 52 extend upwardly from the floor 4. The second plow 52 is positioned so that the leading edge 74 extends upstream the direction of material flow 62 and the trailing edge 76 of the second rabble 52 extends downstream the direction of material flow 62. The second plow 70 is attached to a second support 78 which in-turn is attached to a shaft 80. The shafts 68 and 80 are anchored above moving floor 4 in a manner known in the art.

The first active face 58 defines a first plane 90 and the second active face 72 defines a second plane 92. In accordance with the present invention, the first rabble 50 is positioned upstream in the flow of material in a manner so that the first active face 58 extends generally upwards from the floor 4 and transverse to the direction of material flow 62. Similarly, the second rabble 52 is positioned downstream in the flow of material in a manner wherein the second active face 72 extends upwards from the floor 4 and transverse to the direction of material flow 62. The active faces of the first and second rabbles 50, 52 are suitably oriented relative to the direction of material flow 62 in a manner known in the art to engender mixing of material. The first and second rabbles 50, 52 are oriented so that the material deposited on the floor 4 is moved into contact with the first and second active faces 58, 72. In accordance with an embodiment of the present invention, the first and second rabbles 50, 52 are positioned at an acute angle with respect to the center of rotation 18 of the floor 4 and in a manner wherein the first plane 90 intersects the second plane 92 at or adjacent the second active face 72.

In operation, material deposited on the floor and moved into contact with the first active face 58 of the first, or leading, rabble 50 is elevated from the floor 4 and rolled over away from the first active face 58 thereby creating a void 100 (shown generally in phantom in FIG. 2) behind the first rabble 50. The elevation and rolling over of material in contact with an active face of a rabble occurs in a manner known in the art. The rolled over material and the void 100 are advanced towards the second, or trailing, rabble 52 wherein the material is brought into contact with the second active face 72 of the second rabble 52. The material contacting the second face is elevated from the floor 4 and rolled over into the void 100 behind the first rabble 50.

The first and second rabbles are positioned so that when exposed to a continuous flow of material, the void 100 created behind the first, leading, rabble 50 is almost immediately filled with material rolled into the void 100 by the second, trailing, rabble 52. More specifically, material on the floor in a first path that is advanced into contact with the first active face 58 is elevated away from the floor 4 and rolled over to a second path away from the first active face 58 and in the direction of material flow 62. This rolling over engenders mixing of surface material and the material near the floor wherein the mixed material is deposited, in part, on the top of material building up against the second active face 72. Advancement of the material into contact with the second active face 72 causes the material to be elevated away from the floor 4 and rolled over away from the second active face 72 in the direction of material flow 62 and substantially back to the first path. The material rolled over by the second active face is urged towards the first path and into the void 100 behind the first plow 50. The placement of the second active face 72 relative to the first active face 52 produces in the material a counter rolling action that causes an inversion of material coming into contact therewith. The material exiting the second mixing rabble 52 is approximately at the same radial distance from a center of rotation 18 of the hearth as material entering the first mixing rabble 50.

Figure 3:
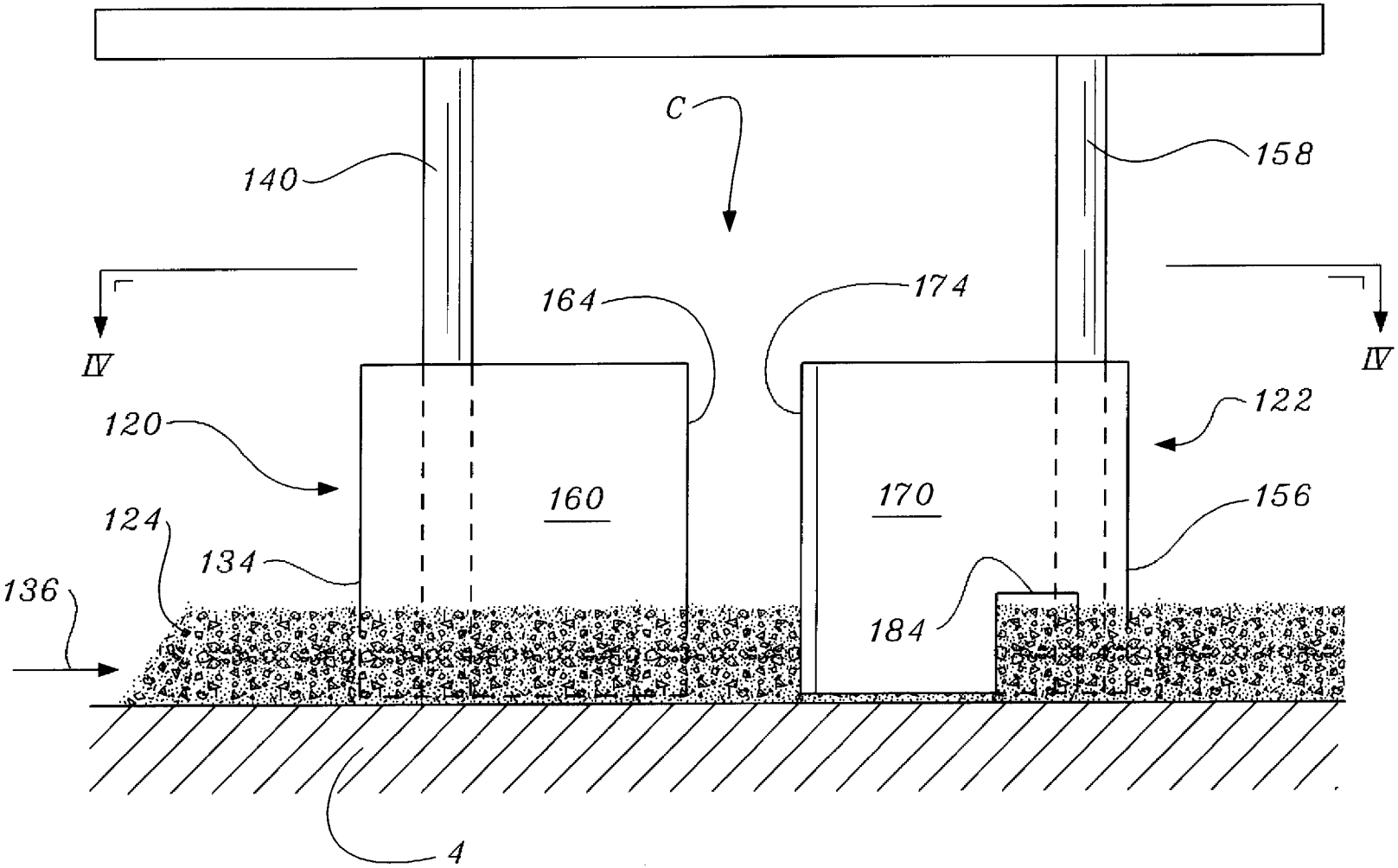
FIG. 3 is a side elevational view of a rabble arrangement in accordance with another embodiment of the present invention in relation to a flow of material on a floor of rotary furnace.
Figure 4:
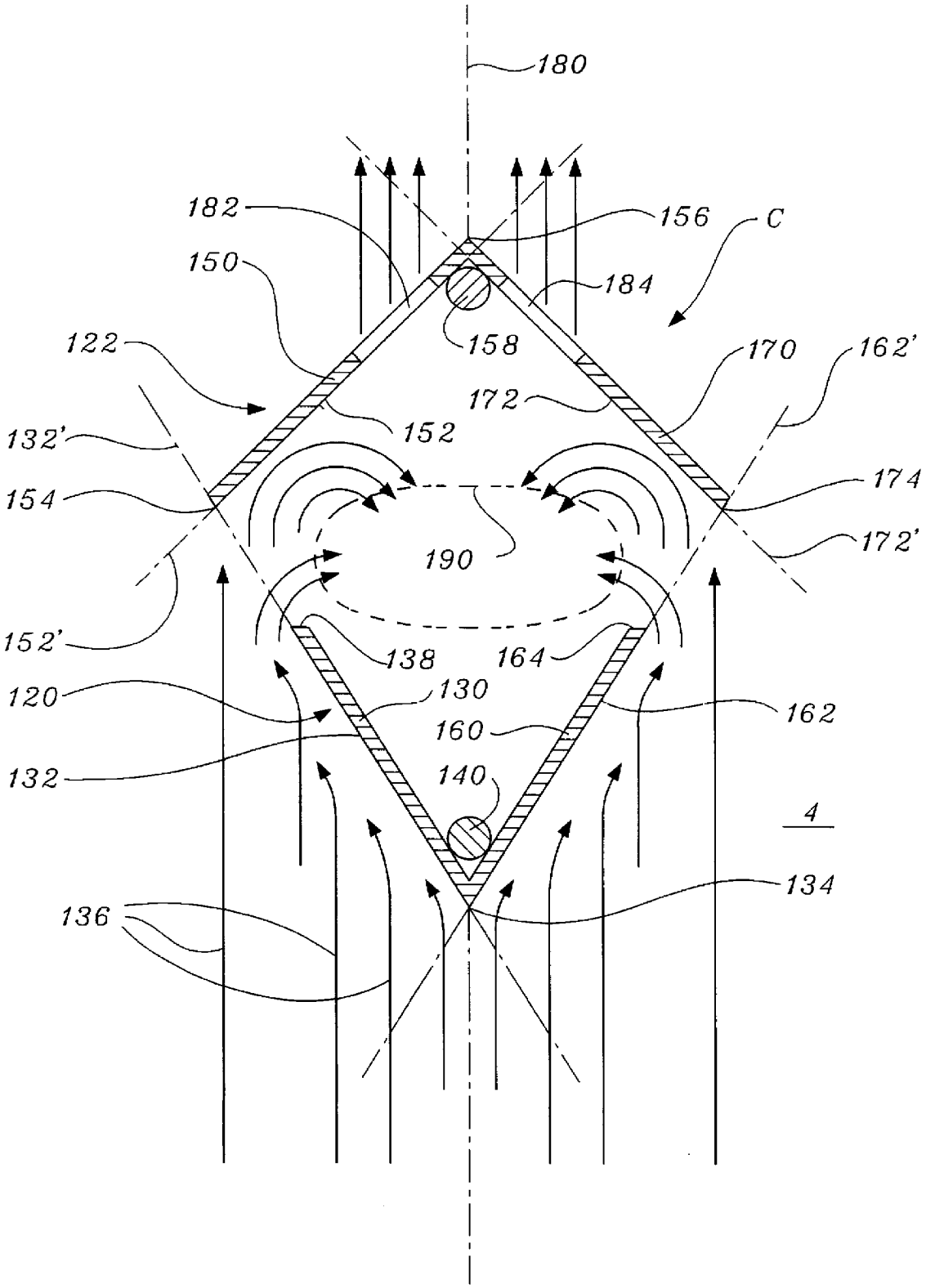
FIG. 4 is a plan view of the rabble arrangement of FIG. 3 as viewed from plane 4—4.

With reference to FIGS. 3–4 and continuing reference to FIG. 1, a rabble arrangement C in accordance with another embodiment of the present invention includes a first, or leading, rabble 120 and a second, or trailing, rabble 122. The first and second rabbles 120, 122 are fixedly supported above and extend closely adjacent the floor 4 of the hearth. The first and second rabbles 120, 122 are positioned at an acute angle with respect to the center of rotation 18 of the floor 4. Material 124 deposited on the floor 4 is moved into contact with the rabble arrangement C by movement of the floor 4 relative to the rabble arrangement C.

The first rabble 120 is comprised of a first plow 130 having a first active face 132, a leading edge 134 that extends upward from the floor 4 and upstream a direction of material flow 136 advancing towards the rabble arrangement C, and a trailing edge 138 that extends upward from the floor 4 and downstream the direction of material flow 136 retreating from the rabble arrangement C. The first rabble 120 is attached to a shaft 140. The second rabble 122 is comprised of a second plow 150 which has a second active face 152, a leading edge 154 and a trailing edge 156. The leading edge 154 and trailing edge 156 of the second rabble 122 extend upward from the floor 4 and upstream and downstream, respectively, the direction of material flow 136. The second rabble 122 is attached to a shaft 158. Shafts 140 and 158 are fixedly anchored above moving floor 4 in a manner known in the art.

The first rabble 120 is further comprised of a third plow 160 having a third active face 162, a leading edge 134 that coincides with the leading edge of the first plow 120, and a trailing edge 164 that extends upward from the floor 4 and downstream the direction of material flow 136.

The second rabble 122 is further comprised of a fourth plow 170 having a fourth active face 172, a leading edge 174 that extends upward from the floor 4 and upstream the direction of material flow 136 and a trailing edge 156 that coincides with the trailing edge of the second plow 152. In one embodiment, the active faces the first and second rabble 120, 122 are substantially flat, however, this is not to be construed as limiting the invention.

The plows of the first rabble 120 form a V wherein the leading edge 134 forms the point of the V and wherein the outside surfaces of the V are the active faces of the first and third plows 132, 162. The first rabble is positioned so that the open end of the V is oriented downstream the direction of material flow 136. The plows of the second rabble 122 form a V wherein the trailing edge 156 of the second rabble forms the point of the V and wherein the inside surface of the V are the active faces of the second and fourth plows 150, 170. The second rabble 122 is positioned with the open end of the V disposed in an upstream direction of material flow 136 and in opposition, or back-to-back, to the open end of the V of the first rabble 120. The leading edge 134 of the first rabble 120 and the trailing edge 156 of the second rabble 122 are positioned at opposite ends of the rabble arrangement C and on or near a line 180 that extends generally parallel to the direction of material flow 136. The plows of the first and second rabbles 120, 122 are positioned transverse to the direction of material flow 136 and positioned so that the rabbles 120, 122 are symmetrical with respect to the line 180. The active faces of the respective plows extend upwards from the floor 4 and are oriented relative to the direction of material flow 136 in a manner known in the art, however, this is not to be construed as limiting the invention. The second and fourth plows 150, 170 have respective apertures 182 and 184 formed therein adjacent the floor for allowing material 124 to pass therethrough in a manner to described in greater detail hereinafter.

The active faces 132, 152, 162 and 172 of the first and second rabbles 120, 122 define planes 132', 152', 162' and 172', respectively. In accordance with the present invention, the first and second plows 130, 150 are positioned so that the plane of the first active face 132' intersects the plane of the second active face 152' on or near the leading edge 154 of the second plow 150. Similarly, the third and fourth plows 160, 170 are positioned so that the plane of the third active face 162' intersects the plane of the fourth active face 172' on or near the leading edge 174 of the fourth plow 170.

In operation, relative movement between floor 4 the rabble arrangement C advances a path of material 124 into contact with the first rabble 120. The first rabble 120 is positioned in the material flow 136 so that material 124 passes to both sides of leading edge 134 and into contact with the active faces 132, 162 of the first rabble 120. The material 124 contacting the active faces of the first rabble is elevated from the floor 4 and caused to roll over in a direction away from the corresponding active faces and in the direction of material flow 136. In this manner, two parallel paths of material 124 are formed on opposite sides of the first rabble 120 for movement in the direction of material flow 136. The splitting of the material 124 into two parallel paths forms a void 190 (shown generally in phantom in FIG. 4) behind the open end of the V of the first rabble 120. Continued movement of the floor 4 relative to the rabble arrangement C advances the void 190 and the material in the two parallel paths towards the second rabble 122. The plows 150, 170 of the second rabble 122 are positioned so that the material in the two parallel paths are brought into contact with the active faces 152, 172 of the second rabble 122. The material contacting the active faces of the second rabble 122 is elevated from the floor 4 and caused to roll over in a direction away from the corresponding active faces in the direction of material flow 136 and substantially back to the first path. The material rolled over from the active faces of the second rabble 122 is relocated into the void 190 created behind the first rabble 120. The material rolled into the void 190 is positioned on the floor 4 so that advancing the material downstream in the direction of the material flow 136 causes the material to pass through apertures 182 and 184 and retreat from the rabble arrangement C.

The back-to-back V shaped rabble arrangement of FIGS. 3–4 engenders in the material a counter rolling action that causes a substantial inversion of material contacting the active faces. The first and second rabbles 120, 122 are positioned so that when exposed to a continuous flow of material, the void 190 created behind the first rabble 120, is almost immediately filled with material rolled into the void 190 by the second rabble 122.

In FIGS. 3–4, the second rabble 122 is illustrated as being formed with apertures 182, 184. It is to be appreciated, however, that the second rabble 122 could alternatively be formed with a single aperture symmetrical to the trailing edge 156 of the second rabble 122.

Figure 5:
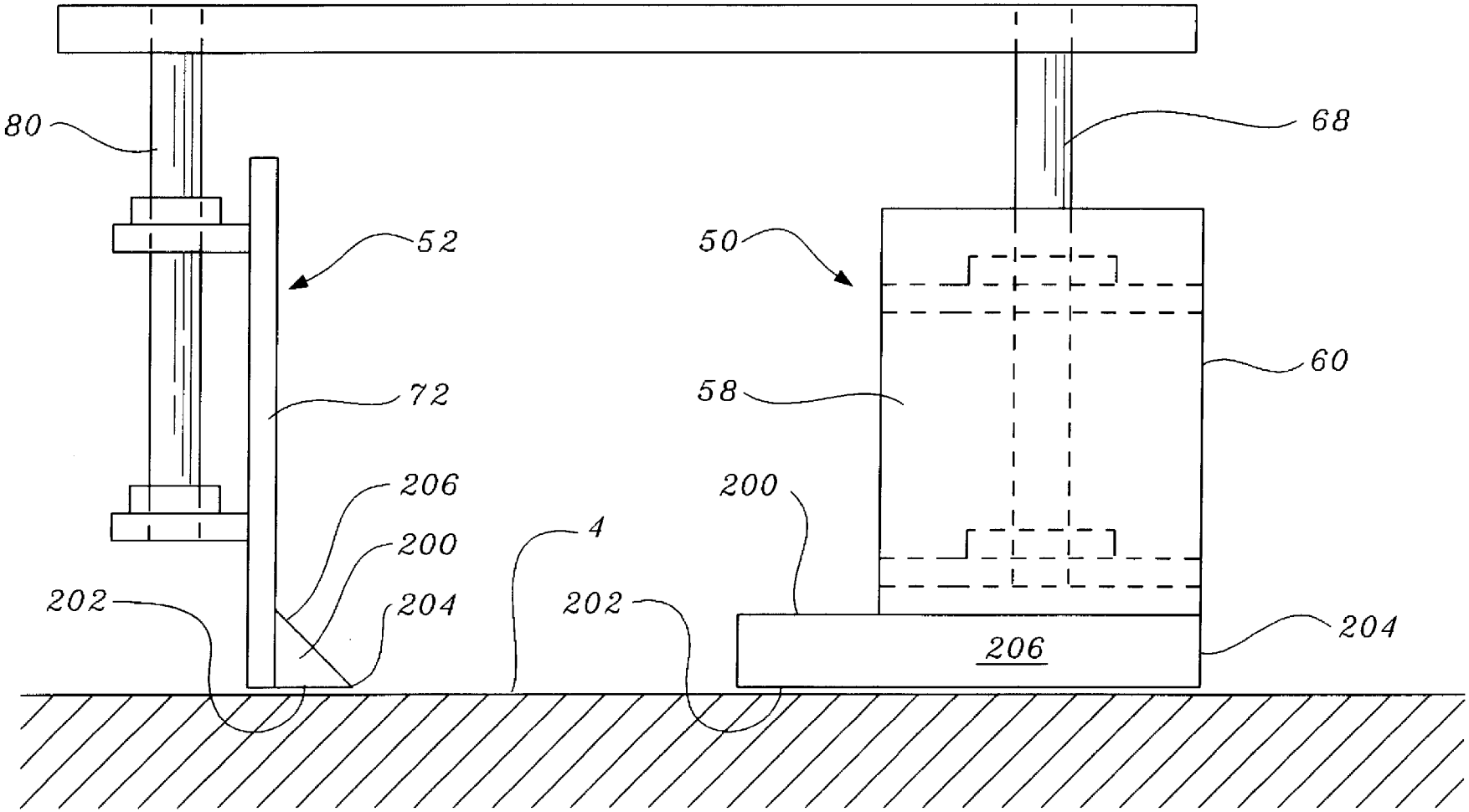
FIG. 5 is a side elevational view of the rabble arrangement of FIG. 2 with a wedge disposed outwardly along a lower portion thereof.

With reference to FIG. 5, in an alternate embodiment of the rabble arrangement of FIG. 2, an outwardly extending wedge 200 is provided at the bottom of the active face, e.g., 58 or 72, of one or both of the first and second rabbles 50, 52. The wedge 200 has a lower surface 202 that extends generally normal to the active face and substantially parallel to and closely adjacent the floor 4. The lower surface 202 terminates in an distal edge 204 disposed parallel to and away from the active face. The wedge 200 has an inclined surface 206 that extends between the distal edge 204 and portion of the active face above the lower surface 202.

In operation, a path of material advancing towards the wedge first encounters the distal edge 204 of wedge 200. Material urged above the distal edge 204 by subsequent material in the path encounters the inclined surface 206 which elevates the material upwardly from the floor 4. Material elevated by the inclined surface 206 encounters the substantially vertical active face of the rabble and is urged upwardly by the force of subsequent material in the path moving towards the wedge 200. The material rising further upwardly on the active face eventually falls away from the active face and downward towards the floor 4. By providing a more gradual transition between the floor 4 and the active face, the wedge 200 engenders a desirable rolling action in the material. It is to be appreciated that the wedge of FIG. 5 is also useable on the active faces of the rabble arrangement of FIGS. 3–4.

While illustrated in conjunction with rotary furnace, it is to be appreciated that the present invention also finds utility in conjunction with other types of furnaces wherein mixing of material being treated is desired.

From the foregoing, it should be appreciated that a mixing rabble arrangement in accordance with the present invention engenders inversion of material on the hearth of a furnace. Moreover, the present invention maintains material mixed by the mixing rabbles at a given circumference on the hearth. Lastly, the present invention provides a compact mixing rabble arrangement that facilitates sufficient mixing of material in less space than mixing rabble arrangements of the prior art.

The above invention has been described with reference to the preferred embodiments. Obvious modifications, combinations and alterations will occur to others upon reading the preceding detailed description. It is intended that the invention be construed as including all such modifications, combination and alterations insofar as they come within the scope of the following claims or the equivalents thereof.

Having described the preferred embodiment the invention is now claimed to be:

1. A mixing rabble arrangement for use in a rotary furnace having a hearth rotatable about a center of rotation, said rabble arrangement fixedly suspended above said hearth for urging material deposited on said hearth from one location to another thereon in response to relative movement between the rabble arrangement and the hearth, said rabble arrangement comprising:

a first rabble disposed upstream in a flow of said material on said hearth, said first rabble comprising a first plow having an active face and a leading edge, the active face of said first plow defining a first plane disposed transverse to the direction of flow of said material; and a second rabble disposed downstream in the flow of material, said second rabble comprising a second plow having an active face, a leading edge positioned upstream said flow of material and a trailing edge positioned downstream said flow of material, the active face of said second plow defining a second plane disposed transverse to the first plane and the direction of flow of said material, wherein:

said first plane intersects said second plane adjacent one of said leading edge and said trailing edge of said second plow;

said first rabble and said second rabble are disposed at an acute angle with respect to the center of rotation;

a lower portion of said first rabble and a lower portion of said second rabble are positioned substantially the same distance above a floor of said hearth;

said first rabble urges the flow of material deposited on the hearth and moved into contact therewith away from the active face thereof thereby creating a void of material behind the first rabble; and said second rabble urges material deposited on the hearth and moved into contact therewith away from the active face thereof and into the void created behind the first rabble whereby the flow of material entering the rabble arrangement and the flow of material exiting the rabble arrangement are at the same radial distance from the center of rotation of the hearth.

2. The rabble arrangement as set forth in claim 1 wherein said first plane intersects said second plane between the leading edge and the trailing edge of said second plow.

3. The rabble arrangement as set forth in claim 1 wherein one of said plows includes a wedge disposed outwardly along the lower portion of the active face thereof, said wedge comprising a lower surface extending generally normal to said active face and an inclined surface extending between a distal edge of said wedge and a portion of said active face above said lower surface.

4. The rotary furnace as set forth in claim 1, wherein the rabble arrangement produces in the material moving into contact therewith a counter rolling action that causes inversion of the material.

5. A rotary furnace comprising a hearth and a rabble arrangement, said rabble arrangement fixedly disposed above said hearth which moves relative to said rabble arrangement which urges a flow of material deposited on said hearth between paths on said hearth, said rabble arrangement comprising:

a first rabble comprised of a first plow having an active face for contacting the flow of material flowing in a first path on said hearth, said first plow positioned to urge the flow of material in the first path to a second path on said hearth thereby creating a void of material behind said first plow; and a second rabble comprised of a second plow having an active face for contacting the flow of material flowing in the second path, wherein:

said second plow is positioned to urge the flow of material moved from the first path into the second path back into the first path and into the void created behind said first plow; and a lower portion of said first rabble and a lower portion of said second rabble are positioned substantially the same distance above a floor of said hearth;

said first rabble and said second rabble are disposed at an acute angle with respect to a center of said hearth.

6. The rotary furnace as set forth in claim 5 wherein the active face of said second plow is substantially perpendicular to the active face of said first plow.

* * * * *